US012404136B2

(12) United States Patent
Picchi et al.

(10) Patent No.: US 12,404,136 B2
(45) Date of Patent: Sep. 2, 2025

(54) METHOD FOR EXTRACTING A CORE FROM A REEL, MACHINE AND EXTRACTION STATION TO CARRY OUT SUCH METHOD

(71) Applicant: GAMBINI S.P.A., Milan (IT)

(72) Inventors: Fabio Picchi, Lammari (IT); Giovanni Buffa, Ponte Buggianese (IT); Paolo Lazzareschi, Lucca (IT)

(73) Assignee: GAMBINI S.P.A., Milan (IT)

( * ) Notice: Subject to any disclaimer, the term of this patent is extended or adjusted under 35 U.S.C. 154(b) by 191 days.

(21) Appl. No.: 18/219,786

(22) Filed: Jul. 10, 2023

(65) Prior Publication Data

US 2024/0025686 A1 Jan. 25, 2024

(30) Foreign Application Priority Data

Jul. 19, 2022 (IT) ..... 102022000015087

(51) Int. Cl.
*B65H 19/22* (2006.01)
*B65H 75/24* (2006.01)

(52) U.S. Cl.
CPC ..... *B65H 19/2292* (2013.01); *B65H 75/243* (2013.01); *B65H 2301/41854* (2013.01); *B65H 2405/461* (2013.01)

(58) Field of Classification Search
CPC ..... B65H 19/22; B65H 19/2292; B65H 2301/4185; B65H 2301/41854; B65H 2405/461
See application file for complete search history.

(56) References Cited

U.S. PATENT DOCUMENTS 6,047,916 A * 4/2000 Onnerlov ..... B65H 19/2261 242/534
6,729,572 B2 * 5/2004 Baggot ..... B65H 18/22 242/532.2

(Continued)

FOREIGN PATENT DOCUMENTS

| | | | |
|---|---|---|---|
| DE | 19957990 | A1 | 6/2001 |
| EP | 2711320 | B1 | 4/2019 |
| WO | WO-2009004659 | A1 | 1/2009 |

OTHER PUBLICATIONS

Search Report issued Mar. 13, 2023 in Italian Patent Application No. IT202200015087, 2 pages.

*Primary Examiner* — Sang K Kim
(74) *Attorney, Agent, or Firm* — Element IP, PLC

(57) ABSTRACT

A method for extracting a core (1) from a reel (2) of paper is described, where the reel (1) has been wound in a winding station upstream of an extraction station (100) of the core (1); the method comprises the steps of providing an extraction element (3) having an expandable element (4), shaped to enter, when in the non-expanded form, within a cavity (5) defined by the inner wall (6) of the core (1) of the reel (2), the core (1) extends according to a central axis (X) which is substantially horizontal when the reel (2) is positioned for extraction; inserting the expandable element (4) of the extraction element (3) in the cavity (5) of the core (1) on which a roll of paper (20) is wound; expanding the expandable element (4) until it engages the inner wall (6) of the core (1); pulling the extraction element (3) in the opposite direction to that of insertion, to extract the core (1) from the reel (2); bring the expandable element (4) back to the non-expanded form; extracting the expandable element (4) from the core (1). A machine (10) for extracting a core (1) from a reel (2) of paper by means of such method and an extraction station (100) for extracting a core (1) from a reel (Continued)

(2) of paper comprising such machine (10) are further described.

13 Claims, 3 Drawing Sheets

(56) References Cited

U.S. PATENT DOCUMENTS

| | | | | |
|---|---|---|---|---|
| 8,713,779 | B2 * | 5/2014 | Acciari ..... | B65H 19/305<br>242/533 |
| 2017/0280946 | A1 | 10/2017 | Weisang et al. | |
| 2018/0141772 | A1 | 5/2018 | Prankl et al. | |

* cited by examiner

METHOD FOR EXTRACTING A CORE FROM A REEL, MACHINE AND EXTRACTION STATION TO CARRY OUT SUCH METHOD

The present invention relates to a method for extracting a core from a reel of wound paper. The present invention also relates to a machine to carry out such method and an extraction station comprising such machine.

The present invention is usefully employed in the sector of the paper of the so called "tissue" typology, i.e., paper for products such as toilet paper, paper towel, and the like.

Indeed, making rolls of multi-ply, generally two-ply or three-ply, laminated tissue paper, starting from reels made of paper material, so called "logs" having a length greater than the final roll of paper, is known. Such logs are obtained by winding a paper tape previously subjected to various processing, on a core made of cardboard generally made in the form of a tubular element, by means of rewinding machines.

In order to form a roll of paper for the final applications, the logs are cut in various unities to create single rolls of paper of shorter lengths.

So called "coreless" reels of paper are known in which the paper is wound in layers so as to form a roll which is however free of core. In particular, such reels have been provided in recent years to cope with environmental problems and in terms of recycling.

In particular, for such products, making the log comprised of core, as the latter performs a supporting structural function during the winding process, and subsequently removing the core before cutting the log in the single rolls, is known.

The patent document EP 2711320 B1 discloses a reel with a core made of deformable plastic which is extracted by means of deformation of the same.

Disadvantageously, the method described in such document is constrained to the material of the core, which needs to have specific mechanical property requirements to elastically deform and be reused, such as for example a ratio between tensile yield strength and elastic modulus higher than 2%.

Furthermore, the described method involves making a core having a length greater than the wound roll of paper, to be able to grab the core and allow the extraction thereof. Disadvantageously, such types of logs are however bulkier with respect to those of a classic log in which the core is as long as the roll of paper.

The task underlying the present invention consists in providing a method for extracting a core from a reel which is alternative to the existing method.

In particular, an object of the present invention is to provide a method for extracting a core from a reel which is applicable for any type of core, and which does not provide greater bulks with respect to a classic log.

Another object of the present invention is to provide a method for extracting a core from a reel which is simple, and which simultaneously allows the production to be increased.

The task set forth above, as well as the mentioned and other objects that will be more apparent below, are achieved by a method for extracting a core from a reel of paper as recited in claim 1, a machine for extracting a core from a reel of paper as recited in claim 5, and a station for extracting a core from a reel of paper as recited in claim 11.

Further features are provided in the dependent claims.

Further features and advantages will be more apparent from the description of preferred, but not exclusive, embodiments of a method for extracting a core from a reel of paper, a machine for extracting a core from a reel of paper by means of such method and an extraction station comprising such machine, illustrated for indicative and non-limiting purposes with the aid of the attached drawings in which:

FIG. 1 shows a perspective view of the extraction station in a step of the method according to the present invention;

FIG. 1*a* shows an enlargement of a portion of FIG. 1;

Figures 1, 1A:
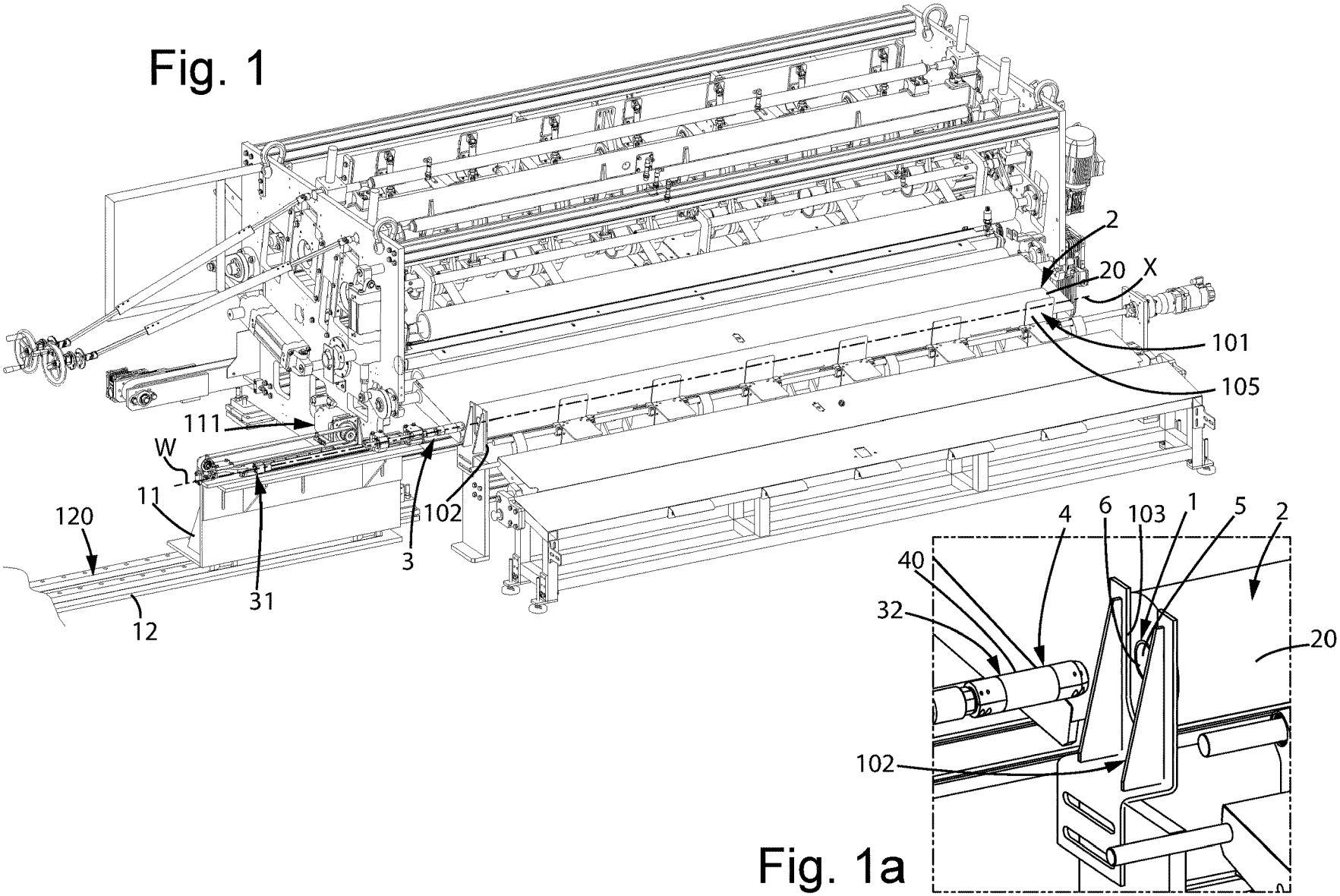
Figure 2:
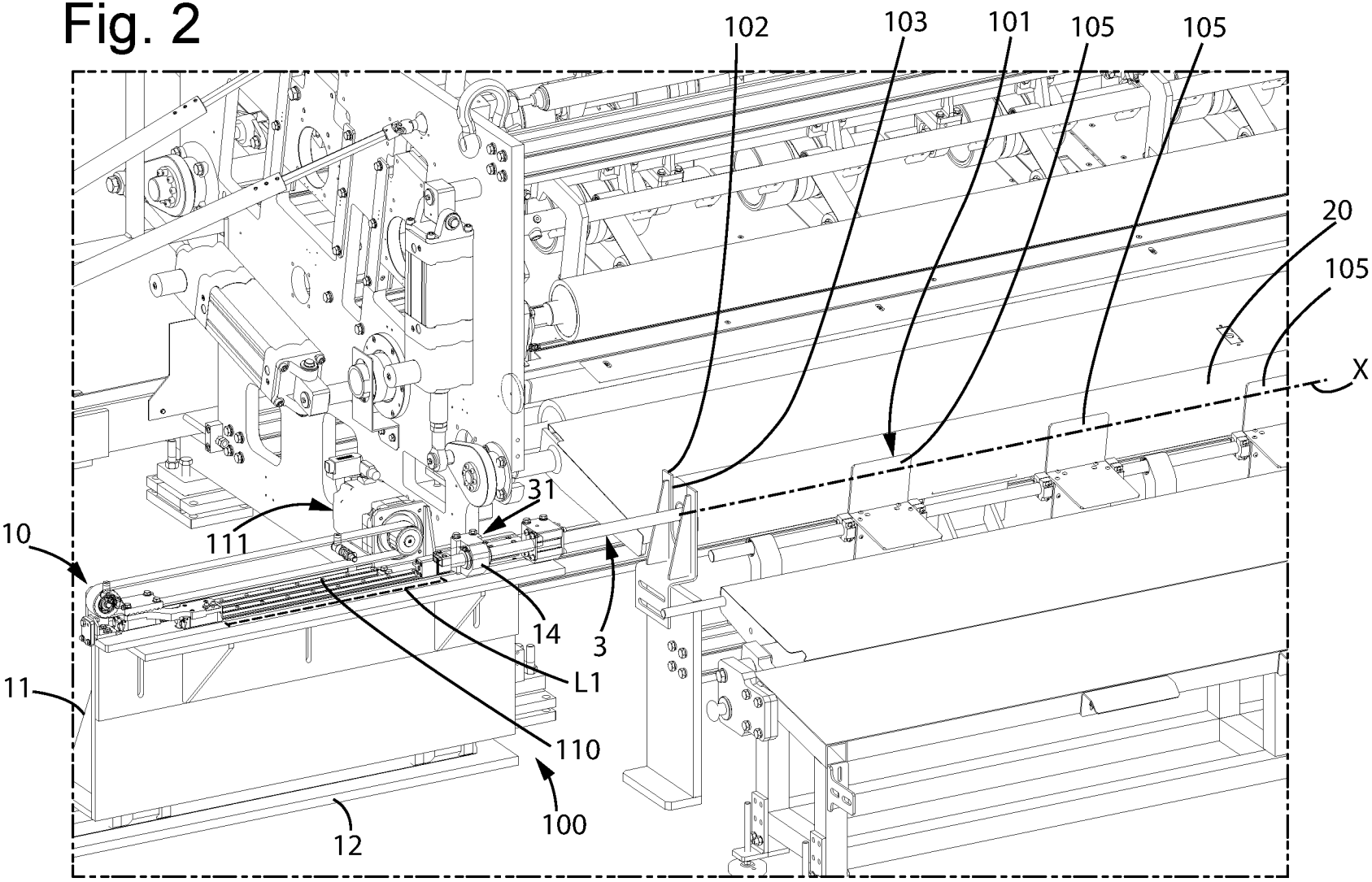
FIG. 2 shows a perspective view of the extraction station in a further step, subsequent to that of FIG. 1, of the method according to the present invention.
Figure 3:
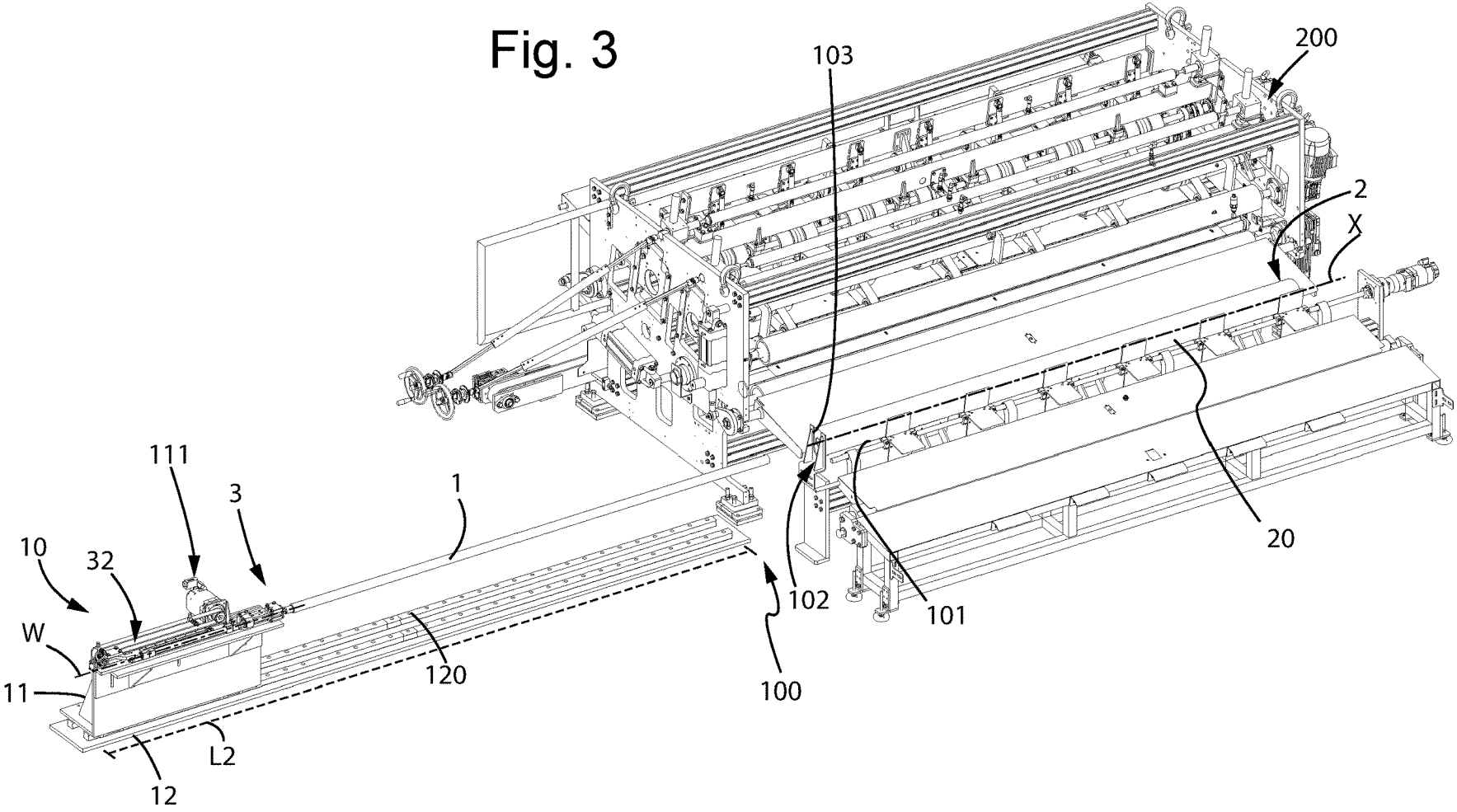
FIG. 3 shows a perspective view of the extraction station in a further step, subsequent to that of FIG. 2, of the method according to the present invention.

With reference to the attached figures, a method for extracting a core 1 from a reel 2 of paper is described below. In particular, such method is preferably carried out by a machine 10 for extracting a core from a reel 2 and a station 100 for extracting a core from a reel 2 comprising such machine 10, both described below.

The method applies to a reel 1 which has been wound in a winding station, placed upstream of an extraction station 100 of the core 1.

In particular, hereinafter in the present description, a reel 2 means the set given by the core 1 and a roll of paper 20 wound on the core 1.

The present method applies to reels 2 having the core made of cardboard or also plastic material.

The method according to the present invention comprises a first step of providing an extraction element 3 having an expandable element 4, where the expandable element 4 is shaped to enter, when in the non-expanded form, within a cavity 5 defined by the inner wall 6 of the core 1 of the reel 2.

The core 1 extends along a central axis X. In particular, such axis is substantially horizontal when the reel 2 is positioned for extraction.

Therefore, the method comprises a second step of inserting the expandable element 4 of the extraction element 3 in the cavity 5 of the core 1 on which a roll of paper 20 is wound.

The method according to the present invention comprises a further step of expanding the expandable element 4 until it engages the inner wall 6 of the core 1. Such step is subsequent to the step of inserting the expandable element 4.

Therefore, the method comprises a step of pulling the extraction element 3 in the opposite direction to that of insertion, to extract the core 1 from the reel 2.

Subsequently, the method comprises a further step of bringing the expandable element 4 back to the non-expanded form.

Once brought the expandable element 4 back to the non-expanded form, the method comprises a step of extracting the expandable element 4 from the core 1.

Preferably, the steps reported above are carried out in the indicated order.

In order to allow the core 1 to be extracted from the reel 2, it should be noted that the roll of paper 20 is glued to the core 1, in the previous steps of the process of forming the log, with a glue having an adhesive strength such as to allow the core 1 to be detached from the roll of paper 20 when the extraction element 3, inserted in the core 1, is pulled in the opposite direction to the reel 2 to extract the core 1. In other words, the glue is a non-aggressive glue, for example having an adhesive strength similar to that used to close the strip in a reel 2.

Advantageously, by means of the method according to the present invention, the core 1 can be separated from the roll of paper 20 and the core 1 can be reused to form further logs.

Preferably, a core 1 having at least the surface facing the roll of paper 20 being smooth can be provided in order to facilitate the extraction.

Still preferably, the step of expanding the expandable element 4 comprises a step of insufflating air in the extraction element 3 to inflate the expandable element 4.

Still preferably, the step of inserting the expandable element 4 of the extraction element 3 within the cavity 5 of the core 1 is preceded by a step of bringing the extraction element 3 to a predetermined position. In particular, in such predetermined position the extraction element 3 is preferably in a position aligned according to the central axis X of the core 1.

Furthermore, the step of inserting the at least one expandable element 4 within the cavity 5 of the core 1 provides inserting the extraction element 3 inside the core 1 for a predetermined length.

Such length can be any length, sufficient to ensure that the expandable element 4 remains inserted within the cavity 5 of the core 1 even at the moment of the extraction.

The described method can be performed manually or, preferably, in an automatic manner.

Therefore, another object of the present invention is a machine 10 for extracting a core 1 from a reel 2 of paper by means of the method described above.

In particular, the machine 10 comprises a support 11 and at least one extraction element 3, placed on the support 11.

The extraction element 3 extends along a main extension direction W, which is substantially horizontal, between a first end 31 and a second end 32.

Preferably, the extraction element 3 comprises the expandable element 4 at the first end 31.

Still preferably, the extraction element 3 comprises at the second end 32 an air supply system 14 configured to insufflate air to inflate the expandable element 4 until engaging the inner wall 6 of the core 1. The air supply system 14, for example, comprises a pressure reducer with a faucet and an electrovalve.

Still more preferably, the expandable element 4 comprises a chamber (not illustrated in the attached figures) in fluid communication with the air supply system 14.

The chamber is externally defined by a rubber portion 40, configured to deform in a circumferential direction when the air supply system 14 insufflates air in the chamber.

In particular, when the reel 2 is positioned for extraction of the core 1 itself, the main extension direction W of the extraction element 3 is parallel to the central axis X of the core 1.

The extraction element 3 comprises an expandable element 4 configured to switch between a non-expanded form and an expanded form.

In particular, the expandable element 4 is shaped to enter, in the non-expanded form, within a cavity 5 defined by the inner wall 6 of a core 1.

On the other hand, the expandable element 4 is configured to exert, in the expanded form, a pressure on the inner wall 6 of said core 1.

Furthermore, the extraction element 3 is movably connected to the support 11 and is configured to penetrate the cavity 5 inside the core 1 by a predetermined length.

Preferably, the extraction element 3 is particularly configured to travel, with respect to the support 11, a first stroke in the direction of the reel 2 to penetrate the cavity 5 by the predetermined length.

Accordingly, the support 11 comprises a first guide 110 to which the extraction element 3 is slidingly constrained.

Preferably, the first guide 110 extends along a direction which is parallel to the central axis X of the core 1, when the reel 2 is positioned for extraction of the core 1 itself. In particular, the first guide 110 has a first length L1 which is equal to the first stroke.

The machine 10 further comprises first moving means 111 configured to move the extraction element 3 along the first guide 110 to travel the first stroke.

Still preferably, the support 11 is configured to travel a second stroke which is in an opposite direction to the first stroke to extract the core 1 from the reel 2. In particular, the second stroke is greater than the length of the core 1.

Advantageously, the entire core 1 can be extracted from the reel 2.

In particular, the machine 10 comprises a base 12 comprising a second guide 120 to which the support 11 is slidingly constrained.

The second guide 120 extends along a direction parallel to the central axis X, when the reel 2 is positioned for extraction of the core 1 itself, for a second length L2 equal to the second stroke.

The machine 10 further comprises second moving means (not illustrated) to move the extraction element 3 along the second guide 120 to travel the second stroke.

According to an embodiment, the machine 10 comprises two or more extraction elements 3, each comprising a respective expandable element 4.

The extraction elements 3 have the respective main extension direction W parallel to each other and are spaced apart by a predetermined distance.

Advantageously, multiple extractions can be simultaneously performed from different reels 2, so as to increase the production volumes.

An extraction station 100 for extracting a core 1 from a reel 2 of paper forms also part of the present invention.

The extraction station 100 comprises a machine 10 as described above.

The extraction station 100 further comprises one or more extraction seats 101, each associated with a respective extraction element 3.

In particular, if the machine comprises more extraction elements 3, as many extraction seats 101 as the extraction elements 3 are provided.

Each extraction seat 101 is flanked by the machine and is shaped to accommodate a reel 2 positioned with its central axis X substantially horizontal. For example, a seat 101 is defined by a plurality of base planes 105 coupled two by two and transverse to each other, having a tilt such as to keep the reel 2 stationary.

Preferably, the seat 101 comprises an abutment plate 102 placed at the end of the seat 101 facing the machine 10. Such abutment plate 102 extends in a plane substantially orthogonal to the central axis X of the core 1 of the reel 2 when the reel 2 is in the seat 101. In particular, such abutment plate 102 is apt to abut with the reel 2 accommodated in the seat 101 for retaining said reel 2 when said core 1 is extracted. In particular, the abutment plate 102 is shaped for retaining the roll of paper 20 and not the core 1. In accordance, the abutment plate 102 comprises a groove 103 shaped to pass the extraction element 3 beyond the abutment plate 102 towards the reel 2 or away from the reel 2 when said extraction element 3 travels the first/second stroke.

Depending on the shaping of the abutment plate 102, the groove 103 is alternatively a through hole formed in the abutment plate 102, or generally a passage formed in the abutment plate 102 adapted to allow the extraction element 3 to enter the cavity 5 of the core 1.

In particular, it should be noted that the extraction station 100 is placed upstream of an accumulator and/or upstream of a cutter.

In particular, the extraction station 100 is preferably placed downstream of a gluing station 200, where the outer strip of the roll 20 is glued so as to keep the reel 2 closed.

Advantageously, rolls of paper of the coreless "tissue" typology and thus having a low weight can be made, reducing the emissions due to the transport thereof.

Advantageously, the waste can further be reduced, providing a core being reusable for various logs.

The method, the machine 10 and the extraction station thus conceived are susceptible to a number of modifications and variations, all falling within the scope of the inventive concept; furthermore, all the details are replaceable by technically equivalent elements. In practice, the used materials, as long as compatible with the specific use, as well as the contingent sizes and shapes, can be any, depending on the technical requirements.

The invention claimed is:

1. A method for extracting a core from a reel of paper, said reel having been wound in a winding station upstream of an extraction station of said core, said method comprising:

providing an extraction element having an expandable element, shaped to enter, when in the non-expanded form, within a cavity defined by the inner wall of the core of said reel, said core extending along a central axis (X) which is substantially horizontal when the reel is positioned for extraction;

inserting the expandable element of said extraction element in said cavity of said core on which a roll of paper is wound;

expanding said expandable element until it engages the inner wall of the core;

pulling said extraction element in the opposite direction to that of insertion, to extract said core from said reel;

bringing said expandable element back to the non-expanded form; and extracting said expandable element from said core, wherein said bringing said expandable element back to the non-expanded form is performed subsequent to the pulling the extraction element in the opposite direction to that of insertion.

2. The method according to claim 1, wherein said expanding said expandable element comprises insufflating air in said extraction element to inflate said expandable element.

3. The method according to claim 1, wherein said inserting the expandable element of said extraction element within said cavity of said core is preceded by a bringing said extraction element to a predetermined position aligned according to said central axis (X) of said core.

4. The method according to claim 1, wherein said inserting the at least one expandable element within said cavity of the core provides inserting said extraction element inside said core for a predetermined length.

5. A machine for extracting a core from a reel of paper comprising:

a support; and at least one extraction element placed on said support and extending along a substantially horizontal main extension direction (W) between a first end and a second end; said extraction element comprising an expandable element configured to switch between a non-expanded shape in which it is shaped to enter within a cavity defined by the inner wall of a core and an expanded shape in which it is configured to exert a pressure on the inner wall of said core; said extraction element being movably connected to said support and being configured to penetrate the cavity inside said core by a predetermined length, wherein said extraction element is configured to travel with respect to said support a first stroke in the direction of the reel to penetrate the cavity by said predetermined length, said support comprising a first guide to which said extraction element is slidingly constrained; said first guide extending along a direction parallel to the central axis (X) of the core and having a first length (L1) equal to said first stroke.

6. The machine according to claim 5, wherein said support is configured to travel a second stroke greater than the length of the core and in an opposite direction to said first stroke to extract said core from said reel; said machine comprising a base comprising a second guide to which said support is slidingly constrained; said second guide extending along a direction parallel to said central axis (X) for a second length (L2) equal to said second stroke.

7. The machine according to claim 5, wherein said extraction element comprises said expandable element at said first end; said extraction element comprising at said second end an air supply system configured to insufflate air to inflate said expandable element until engaging the inner wall of the core.

8. The machine according to claim 5, wherein said expandable element comprises a chamber in fluid communication with said air supply system; said chamber being externally defined by a rubber portion configured to deform in a circumferential direction when said air supply system insufflates air in said chamber.

9. The machine according to claim 5, comprising two or more extraction elements, each comprising a respective expandable element; said extraction elements having the respective main extension directions (W) parallel to each other and being spaced apart by a predetermined distance.

10. An extraction station for extracting a core from a reel of paper, comprising:

a machine according to claim 5; and one or more extraction seats each associated with a respective extraction element; each extraction seat being flanked by said machine and being shaped to accommodate a reel positioned with its central axis (X) substantially horizontal.

11. The extraction station according to claim 10, wherein said seat comprises an abutment plate placed at the end of the seat which is facing the machine; said abutment plate extending in a plane substantially orthogonal to the central axis (X) of the core of the reel when the reel is in the seat and being adapted to abut with the reel accommodated in the seat for retaining said reel when said core is extracted; said abutment plate comprising a groove shaped to pass the extraction element beyond the abutment plate towards/away from said reel when said extraction element travels said first/second stroke.

12. The extraction station according to claim 10, placed upstream of an accumulator and/or upstream of a cutter.

13. A machine for extracting a core from a reel of paper comprising:

a support; and at least one extraction element placed on said support and extending along a substantially horizontal main extension direction (W) between a first end and a second end; said extraction element comprising an expandable element configured to switch between a non-expanded shape in which it is shaped to enter within a cavity defined by the inner wall of a core and an expanded shape in which it is configured to exert a pressure on the inner wall of said core; said extraction element being movably connected to said support and being configured to penetrate the cavity inside said core by a predetermined length, wherein said support is configured to travel a second stroke greater than the length of the core and in an opposite direction to said first stroke to extract said core from said reel; said machine comprising a base comprising a second guide to which said support is slidingly constrained; said second guide extending along a direction parallel to said central axis (X) for a second length (L2) equal to said second stroke.

* * * * *